US008082845B2

(12) United States Patent
Aw et al.

(10) Patent No.: US 8,082,845 B2
(45) Date of Patent: Dec. 27, 2011

(54) SELF DESTRUCTION IMPACT FUSE

(75) Inventors: Cheng Hok Aw, Singapore (SG); Juan Kiat Quek, Singapore (SG); Soo Chew Sie, Singapore (SG)

(73) Assignee: Advanced Meterial Engineering Pte Ltd, Singapore (SG)

( * ) Notice: Subject to any disclaimer, the term of this patent is extended or adjusted under 35 U.S.C. 154(b) by 52 days.

(21) Appl. No.: 12/521,581

(22) PCT Filed: Dec. 19, 2007

(86) PCT No.: PCT/SG2007/000435

§ 371 (c)(1),
(2), (4) Date: Sep. 28, 2009

(87) PCT Pub. No.: WO2008/082365

PCT Pub. Date: Jul. 10, 2008

(65) Prior Publication Data

US 2010/0089269 A1 Apr. 15, 2010

(30) Foreign Application Priority Data

Dec. 28, 2006 (SG) ..... 200609106-0

(51) Int. Cl.
*F42C 9/16* (2006.01)

(52) U.S. Cl. ..... 102/274; 102/272; 102/231; 102/234; 102/237; 102/246; 102/253

(58) Field of Classification Search ..... 102/247, 102/252, 253, 272, 273, 274, 222, 231, 234, 102/237, 239
See application file for complete search history.

(56) References Cited

U.S. PATENT DOCUMENTS

| | | | | |
|---|---|---|---|---|
| 3,910,193 | A * | 10/1975 | Shelley et al. | 102/239 |
| 3,945,323 | A * | 3/1976 | Boswell | 102/222 |
| 3,998,164 | A | 12/1976 | Hadfield | |
| 4,004,521 | A * | 1/1977 | Andrejkovics | 102/267 |
| 4,440,085 | A * | 4/1984 | Rossmann et al. | 102/235 |
| 4,449,455 | A * | 5/1984 | Halssig | 102/234 |
| 4,653,401 | A | 3/1987 | Gatti | |
| 4,969,397 | A * | 11/1990 | Gunther et al. | 102/233 |
| 5,670,736 | A | 9/1997 | Chemiere et al. | |
| 6,237,495 | B1 | 5/2001 | Hok et al. | |
| 6,564,716 | B1 | 5/2003 | Steele et al. | |

FOREIGN PATENT DOCUMENTS

| | | | |
|---|---|---|---|
| CH | 663277 | A5 | 11/1987 |
| DE | 2918039 | A1 | 11/1980 |
| EP | 1500902 | B1 | 8/2005 |

* cited by examiner

*Primary Examiner* — James Bergin
(74) *Attorney, Agent, or Firm* — Pyprus Pte ltd

(57) ABSTRACT

The present invention provides a self destruction impact fuse for fail-proof detonating a projectile, preferably a low velocity projectile. The present invention further provides a projectile that can be detonated reliably even at low velocity.

10 Claims, 5 Drawing Sheets

SELF DESTRUCTION IMPACT FUSE

FIELD OF THE INVENTION

The present invention generally relates to the technologies of ammunition detonation, and more particularly to a self destructing impact fuze that can detonate ammunition reliably when the ammunition is delivered by projectiles, especially the low velocity projectiles.

BACKGROUND OF THE INVENTION

Ammunition comprises two main components, namely projectile and primed cartridge case; the projectile further comprises a fuze and shell body. One type of fuses commonly used in ammunition is impact fuze that detonates the ammunition by the resultant impact from the hitting of the ammunition to its target. However, when ammunition with an impact fuze is delivered, it may fail to explode due to insufficient impact. The insufficient impact may be caused by a variety of reasons including: (1) it misses the target and lands on soft grounds such as a swamp or a snow covered area; or (2) it lands on a suboptimal angle with respect to the point of impact. Unexploded ammunition poses hazards for the civilians and the military alike and operation to remove such unexploded ammunition is dangerous, costly and labor intensive.

Self destructing impact fuses are employed to detonate ammunition delivered with projectiles when the ammunition fails to explode upon impact. Prior art self destructing impact fuses can be generalized into three categories: (1) chemical, (2) mechanical and (3) electronic. Exemplary of a chemical self destructing delay impact is U.S. Pat. No. 3,998,164 issued to Hadfield. '164 described a self destructing fuze illustrating the use of a timing chamber containing liquid in combination with a weight and tubular spring mechanism for releasing the firing pin onto the detonator.

An example of a mechanical self destructing fuze for submunition is U.S. Pat. No. 4,653,401 issued to Gatti. '401 relies on the plastic deformation of a wire element which holds and delays the exertion of a secondary striker member onto the detonator.

Recently electronic self destructing fuses are also developed to detonate projectiles via electronic timing circuitry after they fail to explode upon impact.

The inventors of the present invention have disclosed a self destructing impact fuze in U.S. Pat. No. 6,237,495, where the disclosed self destructing impact fuze incorporated into a self destructing impact fuze the key components which respond to physical forces exerted on the ammunition during the flight of the projectiles, resulting in the enhanced reliability of self destructing fuze without significantly increasing the unit production cost. However, the disclosed self destructing impact fuze is not functioning as well in low velocity projectiles as in high velocity projectiles. Therefore, there is a need to have a self destructing impact fuze that can function reliably in low velocity projectiles.

SUMMARY OF THE INVENTION

One embodiment of the present invention provides a self destructing impact fuze employed in a low velocity projectile for detonating explosive charge coupled thereto. The self destructing impact fuze comprises a frame, a self destructing (SD) firing pin assembly disposed concentrically within said frame, said SD firing pin assembly comprising a SD head on one end for receiving a SD spring, a SD firing pin on the opposite end for striking a detonator, and a centrifugal chamber for holding a plurality of spheres therein, said chamber further communicating with a plurality of radial openings and exposing portion of said spheres when the fuze is spun, a groove disposed on the surface of said SD firing pin assembly for receiving two centrifugal locks, said locks having a pivot offset from the longitudinal axis of said frame and having a symmetric configuration, a setback pin assembly for each of the centrifugal locks for controlling the release of said centrifugal locks from said SD firing pin assembly, said setback assembly having a setback pin retractable upon experiencing acceleration of said projectile; and a support ring disposed concentrically within said frame for balancing the forces exerted radially on said centrifugal chamber with forces exerted axially on said SD firing pin assembly by said SD spring, whereby when centrifugal forces on said projectile push said spheres against said support ring, said support ring prevents said SD firing pin assembly from being lowered onto said detonator so that the detonation is initiated by impact, but when said projectile fails to explode upon impact and reaches the maximum tactical distance, and the compression forces overcome the centrifugal forces on said spheres, said SD spring lowers said SD firing pin assembly onto said detonator so that said projectile is reliably detonated.

Another embodiment of the present invention provides a projectile with a self destructing impact fuze. The projectile comprises a self destructing impact fuze, an escapement assembly comprising at least a rotor assembly and a detonator; and a conical spring disposed between the self destructing impact fuze and the escapement assembly; wherein the self destructing impact fuze comprises a frame, a self destructing (SD) firing pin assembly disposed concentrically within said frame, said SD firing pin assembly comprising a SD head on one end for receiving a SD spring, a SD firing pin on the opposite end for striking a detonator, and a centrifugal chamber for holding a plurality of spheres therein, said chamber further communicating with a plurality of radial openings and exposing portion of said spheres when the fuze is spun, a base disposed at the end of the SD firing pin, said base comprising a point detonation (PD) firing pin near the center of the base, wherein the PD firing pin has a SD firing pin opening for allowing the SD firing pin to pass through, a groove disposed on the surface of said SD firing pin assembly for receiving two centrifugal locks, said locks having a pivot offset from the longitudinal axis of said frame and having a symmetric configuration, a setback pin assembly for each of the centrifugal locks for controlling the release of said centrifugal locks from said SD firing pin assembly, said setback assembly having a setback pin retractable upon experiencing acceleration of said projectile; and a support ring disposed concentrically within said frame for balancing the forces exerted radially on said centrifugal chamber with forces exerted axially on said SD firing pin assembly by said SD spring; whereby after the projectile is launched, the escapement assembly aligns said detonator with the PD firing pin; whereby when centrifugal forces on said projectile push said spheres against said support ring, said support ring prevents said SD firing pin assembly from being lowered onto said detonator so that the detonation is initiated by impact via the PD firing pin, but when said projectile fails to explode upon impact and reaches the maximum tactical distance, and the compression forces overcome the centrifugal forces on said spheres, said SD spring lowers said SD firing pin assembly onto said detonator and the SD firing pin passes through the SD firing pin opening so that said projectile is reliably detonated by the SD firing pin.

The objectives and advantages of the invention will become apparent from the following detailed description of preferred embodiments thereof in connection with the accompanying drawings.

BRIEF DESCRIPTION OF THE DRAWINGS

Preferred embodiments according to the present invention will now be described with reference to the Figures, in which like reference numerals denote like elements.

DETAILED DESCRIPTION OF THE INVENTION

The present invention may be understood more readily by reference to the following detailed description of certain embodiments of the invention.

Throughout this application, where publications are referenced, the disclosures of these publications are hereby incorporated by reference, in their entireties, into this application in order to more fully describe the state of art to which this invention pertains.

In the following detailed description, specific details are set forth in order to provide a thorough understanding of the invention. However, in the following description, numerous specific details are set forth such as centrifugal chamber and firing pin in order to provide a thorough understanding of the present invention. It will be obvious to one skilled in the art that the present invention may be practiced without these specific details. In other instances, description of well-known parts such as those involved with explosive charges and the external structure of a projectile is omitted in order not to obscure the presentation of the present invention.

The present invention provides a self destructing impact fuze that is preferably suitable for low velocity projectiles so that it can reliably detonate explosive charges attached to the low velocity projectiles. The inventors of the present invention have disclosed a self destructing impact fuze with a single centrifugal lock in U.S. Pat. No. 6,237,495, but it is not suitable for low velocity projectiles. Because a low velocity projectile experiences lower rotational forces as compared to a high velocity projectile, the lower rotational forces may fail to release of the single centrifugal lock due to the self destruct spring compressive load exerted on the single centrifugal lock. The self destructing impact fuze of the present invention comprises a dual centrifugal lock design with two centrifugal locks working at the same time, allowing the smooth and swift release of the centrifugal locks of low velocity projectiles. Without wish to be bound by any specific theory or explanation, inventors of the present invention believe that the dual centrifugal lock design results in less compressive load for each of the two centrifugal locks because the compressive load exerted by the SD spring is evenly distributed between the two centrifugal locks. In addition, the dual centrifugal design improves the dynamic stability of the spinning projectiles during the flight.

Figure 1A:
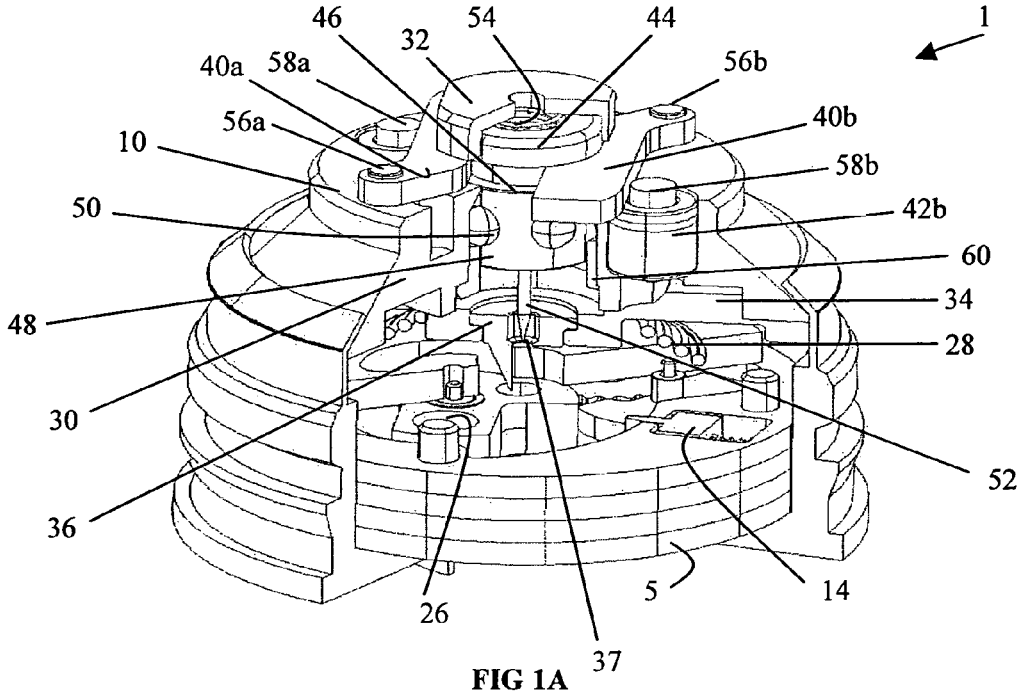
FIG. 1A is a perspective, partial cut away, elevational view of the self destructing impact fuze in accordance with one embodiment of the present invention, showing it being in a "SAFE" position prior to the projectile being propelled through the muzzle.

Referring to FIG. 1A, there is provided a self destructing impact fuze in accordance with one embodiment of the present invention. FIG. 1A is a perspective, partial cut away, elevational view of the self destructing impact fuze, where the self destructing impact fuze is in the "SAFE" position and prior to the projectile being propelled through a muzzle As shown in FIG. 1A, the self destructing impact fuze 1 is a mechanical fuze for initiating explosive charge upon impact of the projectile. The fuze 1 comprises a self destructing fuze 10, an escapement assembly 5, and a conical spring 28 which separates the self destruction fuze 10 and the escapement assembly 5.

Still referring to FIG. 1A, the self destructing fuze 10 comprises a frame 30 having an enclosure 32, a base 34, a self destructing (SD) firing pin subassembly, two centrifugal locks 40*a*, 40*b*, two self destructing (SD) setback pin subassemblies 42*a*, 42*b* and a support ring 60. The frame 30 with the enclosure 32 and the base 34 form a cave of the self destructing fuze 10; the SD firing pin subassembly is disposed in the cave. A point detonation (PD) firing pin 36 is disposed near the center of the base 34 for initiating the explosive charge once the projectile impacts the target. At the same time, the PD firing pin 36 has a SD firing pin opening 37 permitting the SD firing pin assembly to be lowered therethrough when the projectile fails to explode upon impact (to be described in detail with respect to FIGS. 5 and 6).

Referring again to FIG. 1A, the SD firing pin subassembly comprises a self destructing (SD) spring 54, a SD head 44, a SD groove 46, a SD centrifugal chamber 48 and a SD firing pin 52. The SD firing pin subassembly provides fail safe detonation of the explosive charge of the projectile should the projectile fail to explode for reasons given in the background section above. The SD centrifugal chamber 48 is hollow and holds a plurality of spheres 50; the chamber further communicates with a plurality of radial openings 49 disposed on the surface of the chamber 48. When the projectile and the chamber is subjected to centrifugal force, the spheres 50 will be pushed outwards and a portion thereof expose through the radial openings 49. Disposed between the SD head 44 and the SD centrifugal chamber 48 is the SD groove 46 for the purpose of receiving the centrifugal locks 40*a;* 40*b*. The centrifugal locks 40*a*, 40*b* have a pivot 56*a*, 56*b* respectively offset from the longitudinal axis of the frame 30; the centrifugal locks 40*a,* 40*b* lock the SD firing pin subassembly in place with the assistance of the SD setback pin subassemblies 42*a*, 42*b*. The SD setback pin subassemblies 42*a*, 42*b* comprise a SD setback pin 58*a*, 58*b* and a spring (not shown in any of the figures) respectively.

Figure 1B:
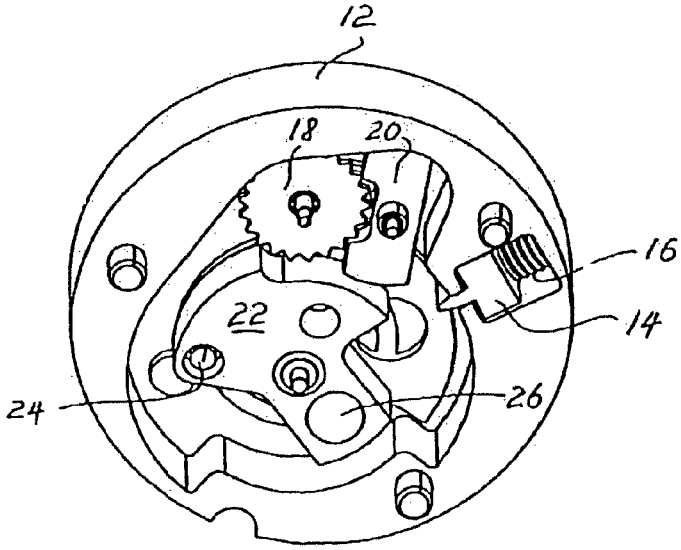
FIG. 1B is a bottom, perspective, elevational view of the escapement assembly 5 of the projectile according to FIG. 1A.

FIG. 1B is a bottom, perspective, elevational view of the escapement assembly 5 as shown in FIG. 1A. The escapement assembly 5 comprises a body 12, a detent 14, a spring 16, a pinion assembly 18, a verge assembly 20 and a rotor assembly 22 for aligning the detonator after a predetermined interval. The rotor assembly 22 comprises an arming lock pin 24 and a detonator 26. It is to be noted that the escapement assembly 5 has been described in detail in U.S. Pat. No. 6,237,495, which is incorporated herein in its entirety, thus no detailed description of the escapement assembly 5 will be provided herein.

FIGS. 1A and 1B describe the unaligned "SAFE" position of the self destructing fuze 10 when the projectile has not yet been launched. Here, the detent 14 locks the rotor assembly 22 in place, while the SD setback pin subassemblies 42*a*, 42*b* also locks the centrifugal locks 40*a*, 40*b* against the SD firing pin subassembly.

Now there is provided a detailed description of the operation of the self destructing impact fuze.

Figure 2A:
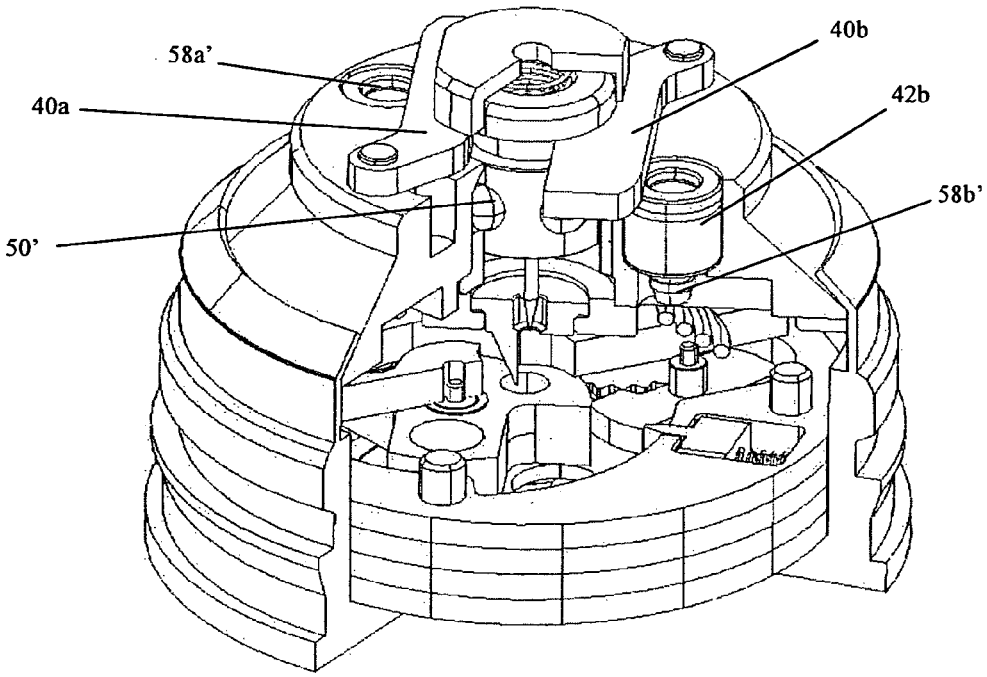
FIG. 2A is a perspective, partial cut away, elevational view of the self destructing impact fuze in accordance with one embodiment of the present invention, showing the retraction of the setback pin during the initial launch of the projectile.
Figure 2B:
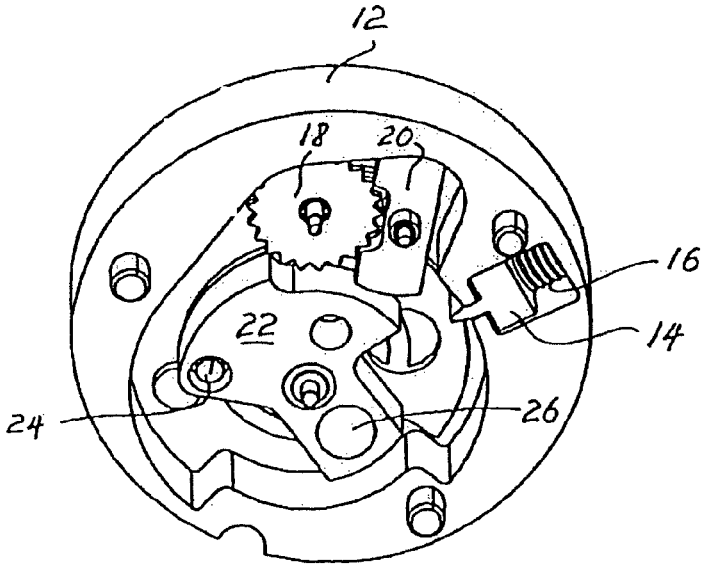
FIG. 2B is a bottom, perspective, elevational view of the escapement assembly 5 of the projectile, showing retraction of the detent and initiation of the timing function of the fuze.

FIG. 2A is a perspective, partial cut away, elevational view of the self destructing impact fuze 1 as shown in FIG. 1A, showing the retraction of the SD setback pins 58*a*', 58*b*' during the initial launch of the projectile. Once the projectile is subjected to a setback force, the springs (not shown) of the SD setback pin subassemblies 42*a*, 42*b* are deflected allowing the SD setback pins 58*a*', 58*b*' to retract. At the same time the centrifugal force (as result of the projectile making its way through the gun barrel and out of the muzzle) is exerted on the SD centrifugal locks 40*a*, 40*b* and the SD spheres 50'. Centrifugal Locks 40*a*, 40*b* lose their contacts with SD groove 46 and move over the SD setback pin subassemblies 42*a*, 42*b* respectively, while the spheres 50' within the SD centrifugal chamber 48 are moved outwards inside the radial openings 49 shown in the drawing. The spheres 50' are urged against the support ring 60 such that the SD firing pin subassembly remains unchanged in its position; therefore, the fuze remains secured and barrel safety is assured. The centrifugal force also acts on the detent 14' and the spring 16' such that they retract and allow the rotor assembly 22 of the escapement assembly in FIGS. 2A and 2B to initiate the arming sequence.

Figure 3A:
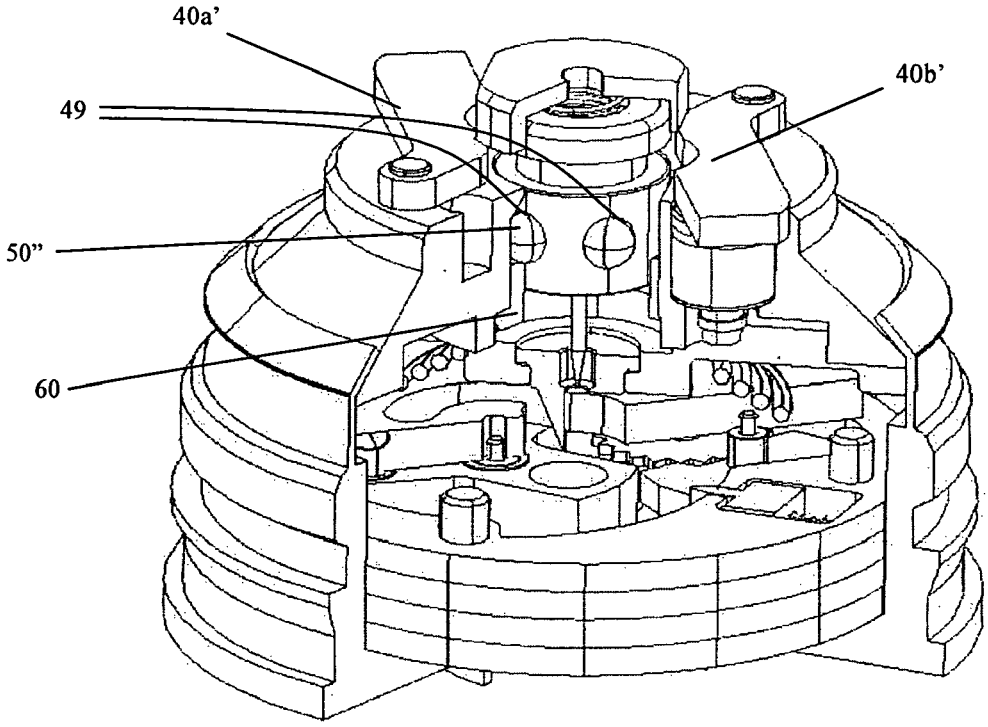
FIG. 3A is a perspective, partial cut away, elevational view of the self destructing impact fuze in accordance with one embodiment of the present invention, showing the full extent of the centrifugal lock and of the centrifugal balls at the maximum acceleration of the projectile.
Figure 3B:
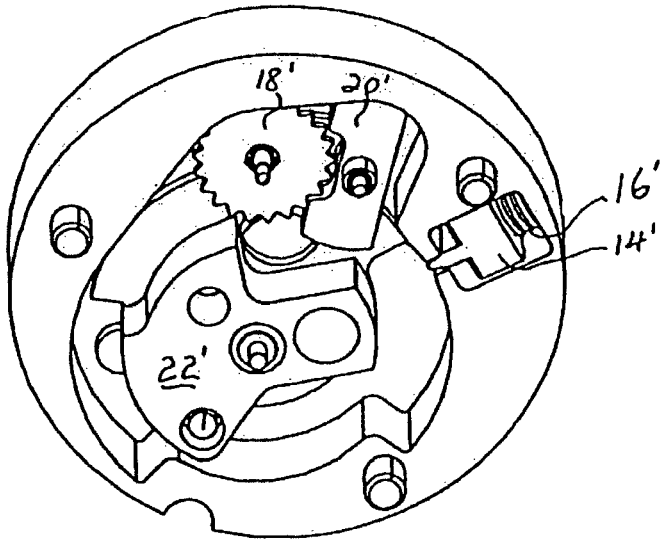
FIG. 3B is a bottom, perspective, elevational view of the escapement assembly 5 of the projectile, showing the gradual alignment of the rotor assembly into an "ARMED" position.

FIG. 3A is a perspective, partial cut away, elevational view of the self destructing impact fuze 1 as shown in FIG. 1A, showing the fuze as the projectile reaches maximum acceleration. Here, the centrifugal locks 40*a*', 40*b*' are fully retracted and the spheres 50" fully extended through the radial openings 49. In combination with the contact with the support ring 60, the spheres 50" are able to overcome the compression force exerted axially by the SD spring 54' on the SD firing pin subassembly. FIG. 3B is a bottom, perspective, elevational view of the escapement assembly 5 as shown in FIG. 1A, showing the gradual alignment of the rotor assembly into an "ARMED" position. Under the influence of radially acting centrifugal forces, the detent 14' and spring 16' continue to be retracted and the rotor assembly 22' rotates into position. The pinion assembly 18' and the verge assembly 20' prevent the rotor assembly 22' from rotating to the "ARMED" position until after the prescribed arming delay time is reached.

Figure 4A:
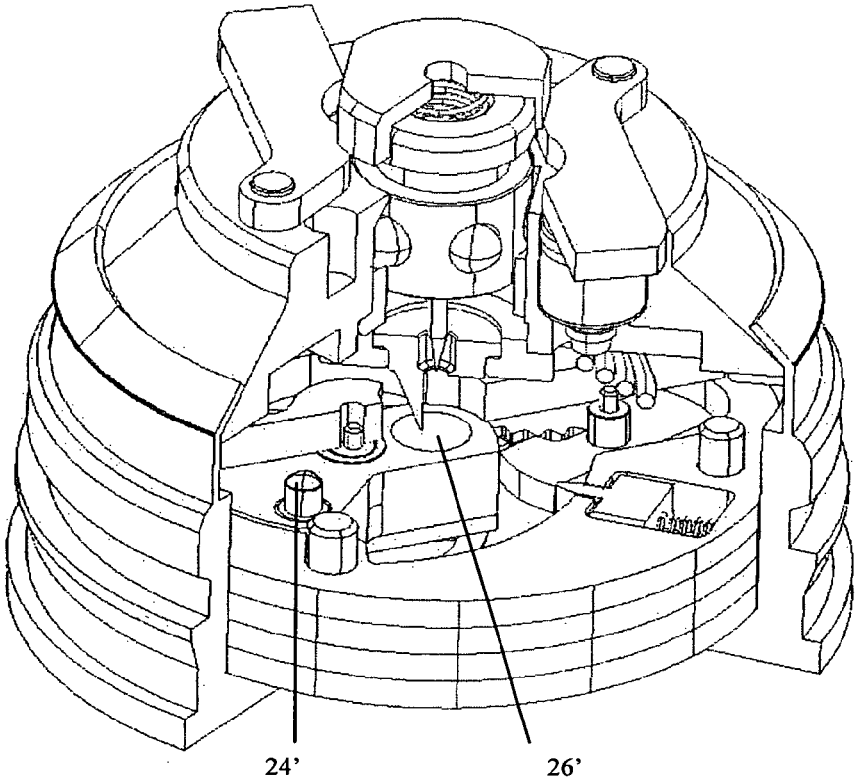
FIG. 4A is a perspective, partial cut away, elevational view of the self destructing impact fuze in accordance with one embodiment of the present invention, showing the alignment of the point detonation (PD) firing pin with the detonator and full extent of the arming lock pin.
Figure 4B:
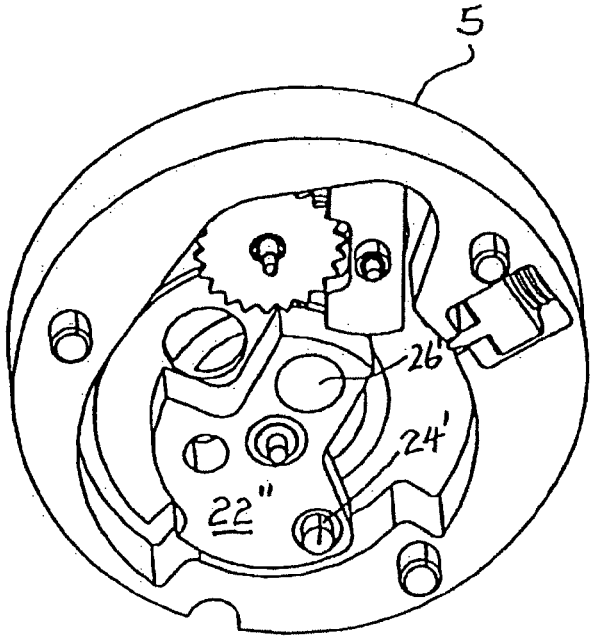
FIG. 4B is a bottom, perspective, elevational view of the escapement assembly 5 of the projectile, showing the extension of the arming lock pin, thereby locking the rotor in the "ARMED" position.

FIG. 4A is a perspective, partial cut away, elevational view of the self destructing impact fuze 1 as shown in FIG. 1A, showing the alignment of the point detonation (PD) firing pin 36 with the detonator 26' and full extent of the arming lock pin 24'. The rotor assembly 22" is shown to align the detonator 26' directly over the PD firing pin 36. In FIG. 4B, the escapement assembly 5 shows the extension of the arming lock pin 24'. Here, the projectile has traveled beyond the muzzle safety distance and before the tactical distance. The arming lock pin 24' prevents the rotor assembly 22" from unarming itself when it fails to hit the target and lands on a soft ground. In other words, the self destructing fuze 10 is armed. Should the projectile impact the target, the escapement assembly 5 accelerates towards the frame. As the detonator 26' is aligned with the PD firing pin 36, it detonates the explosive charge.

Figure 5:
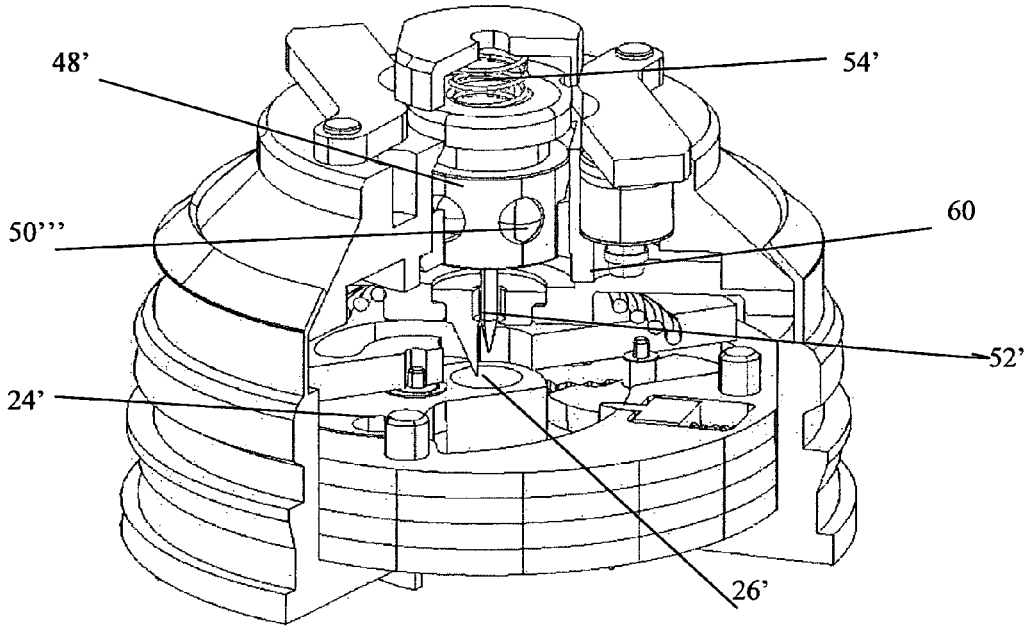
FIG. 5 is a perspective, partial cut away, elevational view of the self destructing impact fuze in accordance with one embodiment of the present invention, showing the lowering of the self destructing (SD) firing pin onto the detonator when the self destructing (SD) spring overcomes the centrifugal force acting on the centrifugal balls.
Figure 6:
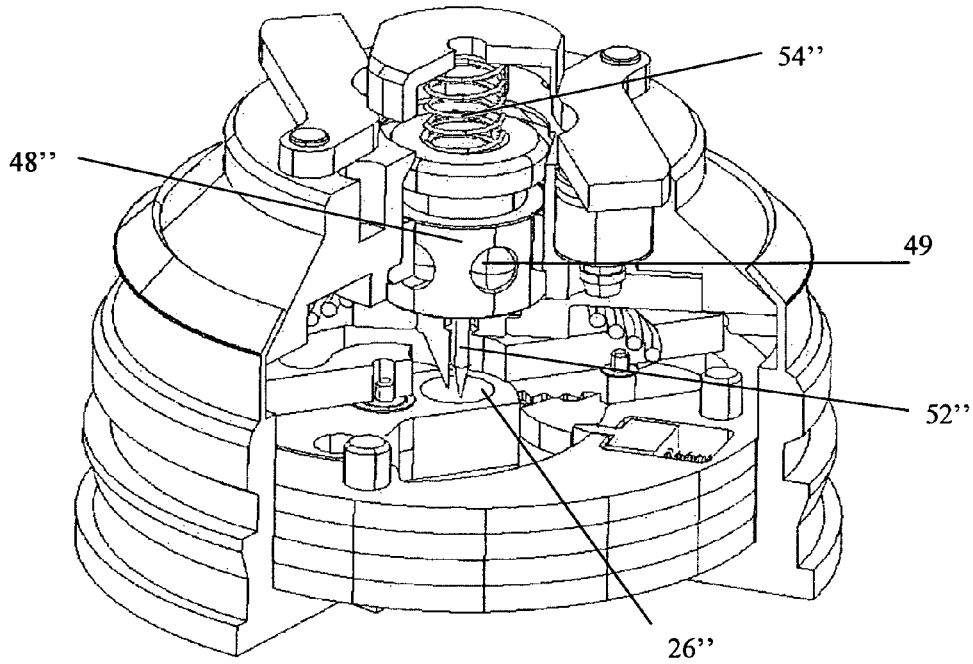
FIG. 6 is a perspective, partial cut away, elevational view of the self destructing impact fuze in accordance with one embodiment of the present invention, showing the self destructing (SD) firing pin striking the detonator of the escapement assembly.

FIGS. 5 and 6 describe the sequence of detonation of the self destructing impact fuze 1 as shown in FIG. 1A when the projectile fails to explode upon impact but reaches the maximum tactical distance. Due to resistance of the air, the rotational speed of the projectile decreases continuously throughout its flight, so that the centrifugal force acting on the fuze 10 is reduced continuously. After a certain flight time, the force exerted by the SD spring 54' on the SD firing pin subassembly in FIGS. 5 and 6 is greater than that of the centrifugal force acting on the spheres 50". The spheres 50" retract from the support ring 60 via the radial openings 49. The SD firing pin subassembly and the SD firing pin 52" are lowered onto the detonator 26" and set off the explosive charge.

The present invention as described in FIGS. 1-6 uses few components and thus results in a compact design for a self destructing impact fuze. Furthermore, the SD firing pin subassembly used in combination with the SD setback pin subassembly ensure that each of the components interact responsively with the physical forces (whether be it acceleration, deceleration and centrifugal) exerted on the fuze. As such, the self destructing fuze of the present invention is reliable. Moreover, each of the components of the present invention is mechanical and used extensively. Therefore, the unit cost of production of the present invention can be minimized.

While the preferred embodiment of the present invention shows a SD firing pin subassembly with a hollow centrifugal chamber and a plurality of spheres, it should be understood that other equivalent configurations are possible. For instance, a plurality of radiating flaps disposed on the centrifugal chamber can be used instead of the spheres to prevent the SD firing pin subassembly from being lowered onto the detonator.

While the present invention has been described with reference to particular embodiments, it will be understood that the embodiments are illustrative and that the invention scope is not so limited. Alternative embodiments of the present invention will become apparent to those having ordinary skill in the art to which the present invention pertains. Such alternate embodiments are considered to be encompassed within the spirit and scope of the present invention. Accordingly, the scope of the present invention is described by the appended claims and is supported by the foregoing description.

What is claimed is:

1. A self destructing impact fuze employed in a low velocity projectile for detonating explosive charge coupled thereto, said self destructing impact fuze comprising:

a frame;

a self destructing (SD) firing pin assembly disposed concentrically within said frame, said SD firing pin assembly comprising a SD head on one end for receiving a SD spring, a SD firing pin on the opposite end for striking a detonator, and a centrifugal chamber for holding a plurality of spheres therein, said chamber further communicating with a plurality of radial openings and exposing portion of said spheres when the fuze is spun;

a groove disposed on the surface of said SD firing pin assembly for receiving two centrifugal locks, each said locks having a pivot offset from the longitudinal axis of said frame and having a symmetric configuration;

a setback pin assembly for each of the centrifugal locks for controlling the release of said centrifugal locks from said SD firing pin assembly, said setback assembly having a setback pin retractable upon experiencing acceleration of said projectile; and a support ring disposed concentrically within said frame for balancing the forces exerted radially on said centrifugal chamber with forces exerted axially on said SD firing pin assembly by said SD spring, whereby when centrifugal forces on said projectile push said spheres against said support ring, said support ring prevents said SD firing pin assembly from being lowered onto said detonator so that the detonation is initiated by impact, but when said projectile fails to explode upon impact and reaches the maximum tactical distance, and the compression forces overcome the centrifugal forces on said spheres, said SD spring lowers said SD firing pin assembly onto said detonator so that said projectile is reliably detonated.

2. The self destructing impact fuze of claim 1 wherein said centrifugal chamber is hollow and cylindrical.

3. The self destructing impact fuze of claim 1 wherein said spheres are configured as radiating flaps.

4. The self destructing impact fuze of claim 1 wherein the number of said spheres is the same as the number of said radial openings.

5. The self destructing impact fuze of claim 1 wherein said groove is disposed between said SD head and said centrifugal chamber.

6. A projectile with a self destructing impact fuze, comprising:

a self destructing impact fuze;

an escapement assembly comprising at least a rotor assembly and a detonator; and a conical spring disposed between the self destructing impact fuze and the escapement assembly;

wherein the self destructing impact fuze comprises:

a frame;

a self destructing (SD) firing pin assembly disposed concentrically within said frame, said SD firing pin assembly comprising a SD head on one end for receiving a SD spring, a SD firing pin on the opposite end for striking a. detonator, and a centrifugal chamber for holding a plurality of spheres therein, said chamber further communicating with a plurality of radial openings and exposing portion of said spheres when the fuze is spun;

a base disposed at the end of the SD firing pin, said base comprising a point detonation (PD) firing pin near the center of the base, wherein the PD firing pin has a SD firing pin opening for allowing the SD firing pin to pass through;

a groove disposed on the surface of said SD firing pin assembly for receiving two centrifugal locks, each locks having a pivot offset from the longitudinal axis of said frame and having a symmetric configuration;

a setback pin assembly for each of the centrifugal locks for controlling the release of said centrifugal locks from said SD firing pin assembly, said setback assembly having a setback pin retractable upon experiencing acceleration of said projectile; and a support ring disposed concentrically within said frame for balancing the forces exerted radially on said centrifugal chamber with forces exerted axially on said SI) firing pin assembly by said SD spring;

whereby after the projectile is launched, the escapement assembly aligns said detonator with the PD firing pin;

whereby when centrifugal forces on said projectile push said spheres against said support ring, said support ring prevents said SD firing pin assembly from being lowered onto said detonator so that the detonation is initiated by impact via the PD firing pin, but when said projectile fails to explode upon impact and reaches the maximum tactical distance, and the compression forces overcome the centrifugal forces on said spheres, said SD spring lowers said SD firing pin assembly onto said detonator and the SD firing pin passes through the SD firing pin opening so that said projectile is reliably detonated by the SD firing pin.

7. The projectile of claim 6 wherein said centrifugal chamber is hollow and cylindrical.

8. The projectile of claim 6 wherein said spheres are configured as radiating flaps.

9. The projectile of claim 6 wherein the number of said spheres is the same as the number of said radial openings.

10. The projectile of claim 6 wherein said groove is disposed between said SD head and said centrifugal chamber.

* * * * *

UNITED STATES PATENT AND TRADEMARK OFFICE

CERTIFICATE OF CORRECTION

PATENT NO. : 8,082,845 B2
APPLICATION NO. : 12/521581
DATED : December 27, 2011
INVENTOR(S) : Cheng Hok Aw, Juan Kiat Quek and Soo Chew Sie It is certified that error appears in the above-identified patent and that said Letters Patent is hereby corrected as shown below:

Title page, Item (73), delete "Meterial" and replace with "Material"

Column 8, line 15, claim 6, add the word "said" after "each"

Column 8, line 25, claim 6, delete "SI)" and replace with "SD"

Signed and Sealed this
Sixth Day of March, 2012

David J. Kappos

David J. Kappos
*Director of the United States Patent and Trademark Office*